US005188661A

United States Patent [19]

Cook et al.

[11] Patent Number: 5,188,661

[45] Date of Patent: Feb. 23, 1993

[54] DUAL PORT LANCE AND METHOD

[76] Inventors: Donald R. Cook, 5406 W. 155th Ave., Lowell, Ind. 46356; Joseph A. Macri, R.D. 1, Pulaski, Pa. 16143

[21] Appl. No.: 790,555

[22] Filed: Nov. 12, 1991

[51] Int. Cl.[5] ..... C21C 5/32

[52] U.S. Cl. ..... 75/387; 266/83; 266/225; 75/533

[58] Field of Search ..... 266/44, 47, 216, 225, 266/226, 83; 75/387, 708, 531-539

[56] References Cited

U.S. PATENT DOCUMENTS

| | | | |
|---|---|---|---|
| 1,205,611 | 11/1916 | Ford . | |
| 2,806,781 | 9/1957 | Shepherd et al. . | |
| 3,792,849 | 2/1974 | Kosmider et al. | 266/34 |
| 4,248,409 | 2/1981 | Langlitz et al. | 266/268 |
| 4,261,551 | 4/1981 | Fassbinder | 266/47 |
| 4,264,059 | 4/1981 | Benatar | 75/387 |
| 4,518,422 | 5/1985 | Metz . | |
| 4,575,393 | 3/1986 | Bates et al. . | |
| 4,613,113 | 9/1986 | Saito et al. | 266/83 |
| 4,740,241 | 4/1988 | LaBate | 266/225 |
| 4,799,651 | 1/1989 | Lazcano-Navarro et al. | 266/245 |

FOREIGN PATENT DOCUMENTS

| | | | |
|---|---|---|---|
| 1-252716 | 10/1989 | Japan | 75/533 |

*Primary Examiner*—Melvyn J. Andrews
*Attorney, Agent, or Firm*—Buchanan Ingersoll

[57] ABSTRACT

A apparatus is disclosed which is utilized for treatment of molten metal contained in a vessel by injection of powdered reagent below the surface of the molten metal which includes an elongated lance body containing longitudinal conduits for delivery of the powdered reagent below the surface of the molten metal, a first and second reagent supply device and a control device which independently regulates the flow of the reagent in a pressure stream of gases through the conduits. The first and second reagent supply device provides the reagent which is injected into a pressure stream by the control device. Each of the flows through the conduits are regulated independent of one another in order to prevent clogging of the exit ports of the conduits while eliminating any splash and turbulence.

12 Claims, 2 Drawing Sheets

DUAL PORT LANCE AND METHOD

FIELD OF INVENTION

This invention relates to the apparatus and method for treatment of iron and steel in a molten metal bath for the purpose of reducing the sulfur content in the molten metals. An immersion lance containing conduits is placed in the molten metal bath and a powdered reagent in a stream of gas is fed through the conduits into the molten metal bath.

BACKGROUND OF THE INVENTION

Normally, an immersion lance having one conduit which delivers the powdered reagent to the molten metal bath is utilized for the process of treating the metals. In this instance the exit port of the conduit which is positioned in the molten metal bath may get clogged with solidified metal or slag and thus reduces the life of the immersion lance requiring the lance to be replaced and disrupting the treatment of the metal. A dual port lance was introduced to overcome the limitations of the single port lance. The conventional dual port lance contains one conduit which branches off into two or more exit ports that are immersed into the metal bath. With a conventional dual port lance, it is nearly impossible to keep equal flows to both ports. Consequently, one port gets a reduced flow of gas/solids. This allows liquid metal to penetrate the port and freeze, further restricting flow through that port. In a matter of minutes the port plugs with metal, leaving the operator with a single port lance with excessive gas flows. Thus, the conventional dual port lance is also susceptible to slag or solidified metal clogging the exit ports of the feed tube. That increased flow would create unacceptable splash and turbulence and possibly cause unacceptable distribution of injected material. An increase in the pressure into the conduit was thought to be able to keep the flow path in the conduit clear, but this resulted in an unacceptable splash in the molten metal bath.

In order to overcome the limitations of unacceptable splash and clogging of the conduits of the conventional lances, the present invention provides multiple conduits each having independently controlled pressure streams of the powdered reagent. The structure of the present invention eliminates the problem of clogging of the dual port lance conduits because there is no venting of the pressure stream from a clogged port to a clear exit port, thus no unacceptable splash will occur. When solidified metal or slag obstructs an exit port of the present invention the line pressure will increase and usually clear the obstruction. Once the obstruction in the exit port is cleared, the pressure will return to the initial pressure. Furthermore, if necessary the flow rate into the conduit can be increased manually to clear an obstruction that is detected by a monitoring system, thus resulting in the removal of the obstruction. After the obstruction is removed the pressure can be decreased manually to the initial pressure. Admittedly, the exit ports may get clogged in a way that no amount of pressure will remove the obstruction. With the single port lance, replacement would be necessary which would interrupt the treatment process. Whereas, if one of the dual ports became unrepairably clogged in the present invention the treatment process of the metals need not be interrupted because the other of the exit ports will still be operable to complete the treatment process.

Because there are two exit ports in the present invention dual port lance versus the single exit port in the conventional single port lance, and each exit port of the present invention has increased flow in comparison with the conventional lances, less time is necessary for every heat. The fact that less time per heat is necessary allows for more heats to be completed during the life of the dual port lance. Therefore, less dual port lances are necessary for the same desulfurization process done by a conventional single port lance.

BRIEF DESCRIPTION OF THE INVENTION

The present invention provides an apparatus for the treatment of molten metals contained in a vessel by the injection of powdered reagents into a molten metal bath via a dual port lance containing a pair of conduits for delivery of a powdered reagent below the surface of the molten metals, a first and second reagent supply means for delivery of the reagent in a pressure stream through the conduits and control means for independently regulating the separate flow rates of the reagent through each of the conduits one from the other flow rate. The above noted structure prevents clogging of the conduits and unacceptable splash in the molten metal bath.

A major improvement over the prior art is the control means of the present invention that allows for individual control over the injection parameters of each of the conduits. The control means can include a single injector conduit conveying a pressure stream and accompanied by a number of feed control modules to regulate the flow rate of the powdered reagent or a series of injector conduits conveying a reagent stream under pressure each having their own feed control modules. With the latter embodiment, the present invention has the advantage of combining several different reagents into a mixture of reagents or if more of a stirring effect is essential to the treatment process of the metal a pressure stream of gas alone can be fed through a number of conduits along with the powdered reagents being fed through separate conduits. By having a separate control module for every substance being delivered to the molten metal bath each stream is controlled, thus the flow rate can be adjusted to regulate the mixture of the various substance being fed via the conduits into the molten metal bath and to prevent splash and turbulence. A further adjustment of the flow rate can be made for the purpose of clearing an obstruction manually from the exit port of the conduit.

The above mentioned adjustment of the flow rate to clear an obstruction of slag or metal in the exit port of the conduit is many times not necessary because of the present invention. The present invention dual port lance provides separate conduits with their respective exit streams being individually controlled whereas, the prior art dual port lance has one conduit that branches off into two exit ports. The prior art dual port lance has the tendency to clog in one of the exit ports from an obstruction of solidified metal or slag and as a result the other exit port excretes an increased flow rate having unacceptable splash. Moreover, the dual port lance of the present invention is more advantageous than the conventional dual port lance because when a piece of slag obstructs the exit port the system will rectify itself if the obstruction is not too large. The obstruction in the conduit will cause an increase in pressure that will many times clear the conduit and the pressure stream will return to normal flow. The dual port lance does not have the chance of creating unacceptable splash resulting from the venting of pressure stream from an obstructed conduit as is the case with the prior art since the conduits pressure stream can not exceed the transport line pressure which is independently controlled.

Another advantage of the conduits having their respective pressure streams controlled is that it allows both of the injection ports to be kept open and functional while requiring much less material flow than the prior art dual port lance. By strictly regulating the amount of powdered reagent being injected into the molten metal bath one prevents waste of the reagent. Any reagent injected into the molten metal bath above the amount needed for treatment of the metals burns off and escapes into the atmosphere.

The present invention provides several embodiments of the lance body which allows one to direct the injected powdered reagent in the molten metal bath. The ability to direct the injected reagent creates a more even dispersement and mixing of the reagent throughout the treated metals and thus a higher quality product.

The present invention further provides a monitoring system which detects obstructions in the conduits. As noted above, many times the system will rectify itself by building up pressure behind the obstruction which will clear the obstruction from the exit port of the conduit. The presence of the monitoring system creates the option of manually clearing the obstruction by increasing the flow rate through the conduit once the clog is detected and returning the pressure back to the initial pressure.

The present invention provides that the lance body be made from ceramic because of its heat resistance property.

Other details, objects and advantages of the invention will become apparent as the following description of certain present preferred embodiments thereof and a present preferred method of practicing the same proceeds.

Description of the Preferred Embodiments

Figure 1:
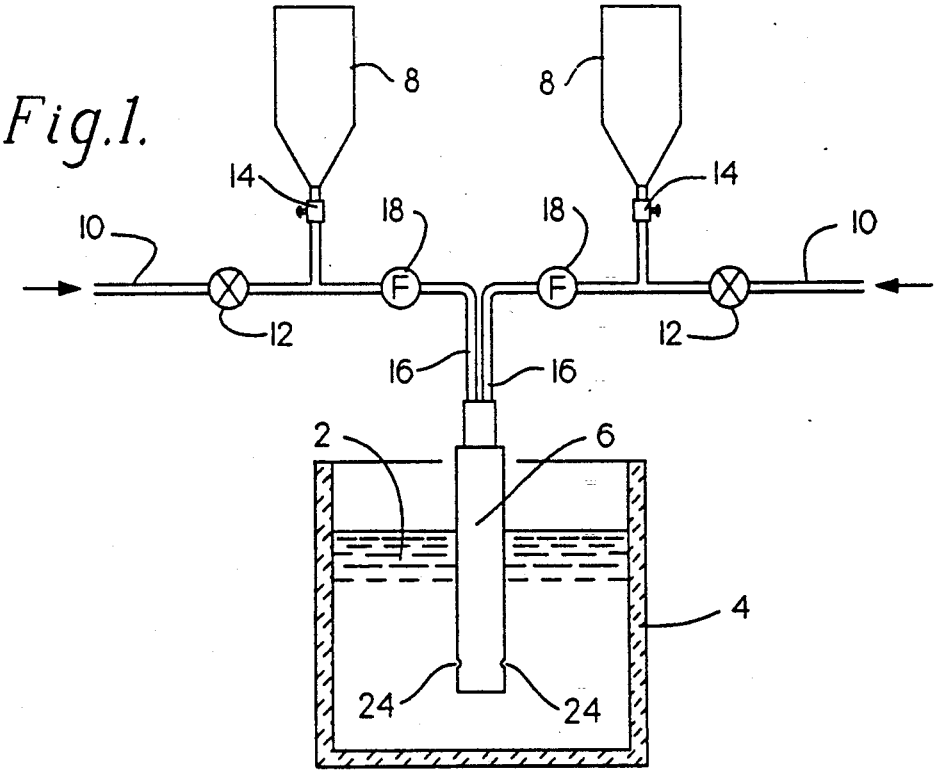
FIG. 1 is a diagram of our present preferred embodiment including the dual port lance and control means in accordance with the present invention.
Figure 2:
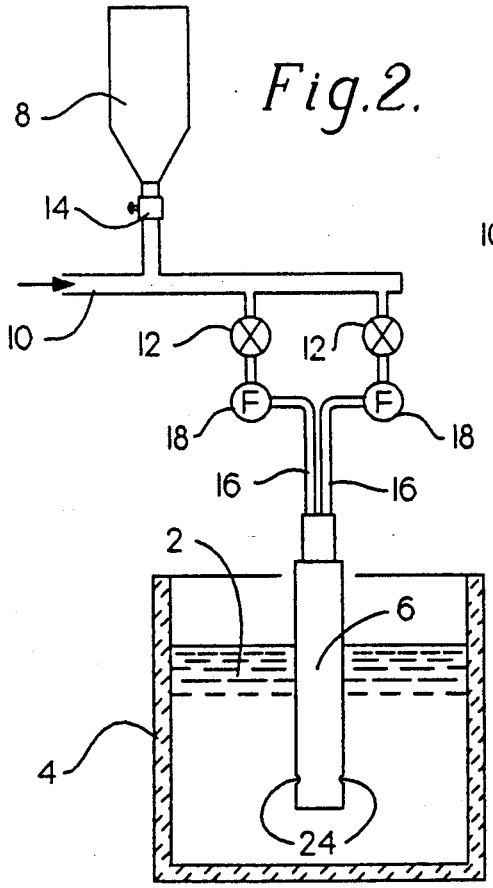
FIG. 2 is a diagram of a second present preferred embodiment.

FIGS. 1 and 2 illustrate the apparatus of the present invention for the treatment of molten metals 2 in a vessel 4. A dual port lance 6 substantially made of ceramic is immersed in a bath of molten metals 2 and powdered reagents are injected into the bath in a pressure stream. The powdered reagent is stored in one or more dispensers 8 which are connected to a series of injector conduits shown in FIG. 1 through which a pressure stream of gases is being injected. As can be seen in FIG. 2 a single injector conduit 10 can also convey the reagent stream to two conduits 16 through independent control units 12. The pressure stream of gases originates from a remote source (not shown). Most mills have pressurized gas lines carrying nitrogen or other suitable gases which can supply a carrier stream. A feed control unit 12 regulates the carrier stream and valves 14 control dispersion of the powdered reagent into the stream. The stream of reagent and carrier gas flow into conduits 16 which are made of steel and pass into the dual port lance 6 and enter the molten metal bath 2 through exit ports 24. The apparatus of the present invention is also equipped with a flow meter 18 which monitors the flow rate of the powdered reagent in the pressure stream and which can detect an obstruction in the feed line 10 and conduits 16. Independent feed control units 12 regulate the flow rate to allow the powdered reagent in the pressure stream to be injected through the pipes at a low enough rate that splash and turbulence are prevented and at a high enough rate to prevent clogging by slag or solidified metal.

By referring to FIGS. 1 and 2 it will be seen that unacceptable splash and clogging are prevented by the independent control of flow rates through the feed lines 10 and conduits 16. If there is an obstruction which closes or partially closes an exit port 24 there will be an increase in pressure behind the obstruction. The increase in pressure will normally clear the obstruction and the flow will revert back to the initial pressure. The pressure will not increase above the supply limit. Thus, there is no chance of unacceptable splash occurring.

As can be seen in FIGS. 1 and 2, our system may have series of individual dispensers 8 as shown in FIG. 1 or a single dispenser 8 supplying material to more than one conduit 16 where each conduit 16 has its own feed control unit 12 to control the injection parameters of the material which enters the conduits 16 as shown in FIG. 2. Having a series of dispensers 8 allows for more than one powdered reagent to be mixed into the molten metal bath.

Figure 3:
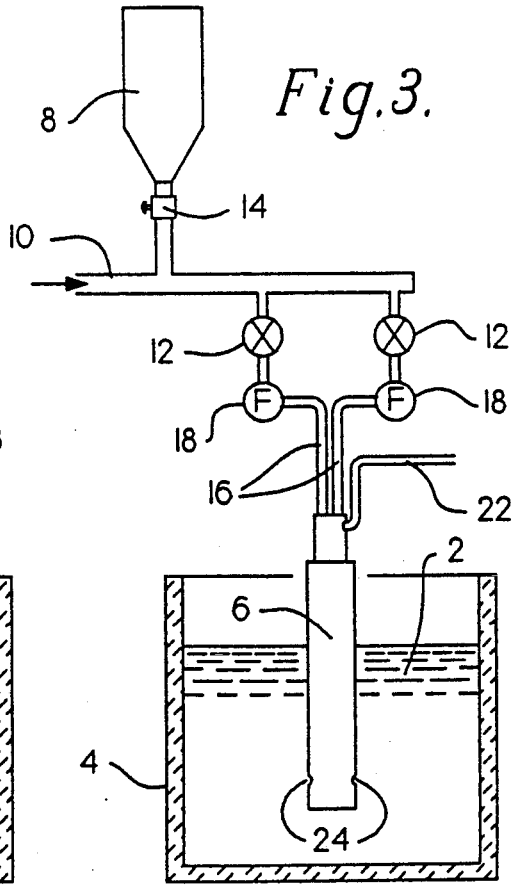
FIG. 3 is a diagram of a third present preferred embodiment of the apparatus of the present invention including the dual port lance and an additional conduit for the injection of gases used as a mixing agent.

As can be seen in FIG. 3, if more of a stirring agent is necessary to the desulfurization process than can be offered by the apparatus of FIGS. 1 and 2, additional conduits 22 can be inserted into the immersion lance 6, thus injecting more gases into the molten bath 2. The drawing of FIG. 3 illustrates the additional conduit 22 which provides additional gas streams utilized with the control system including a single conduit 10 conveying a pressure stream injector. But, it is also possible for several additional conduits to be utilized.

Figure 4:
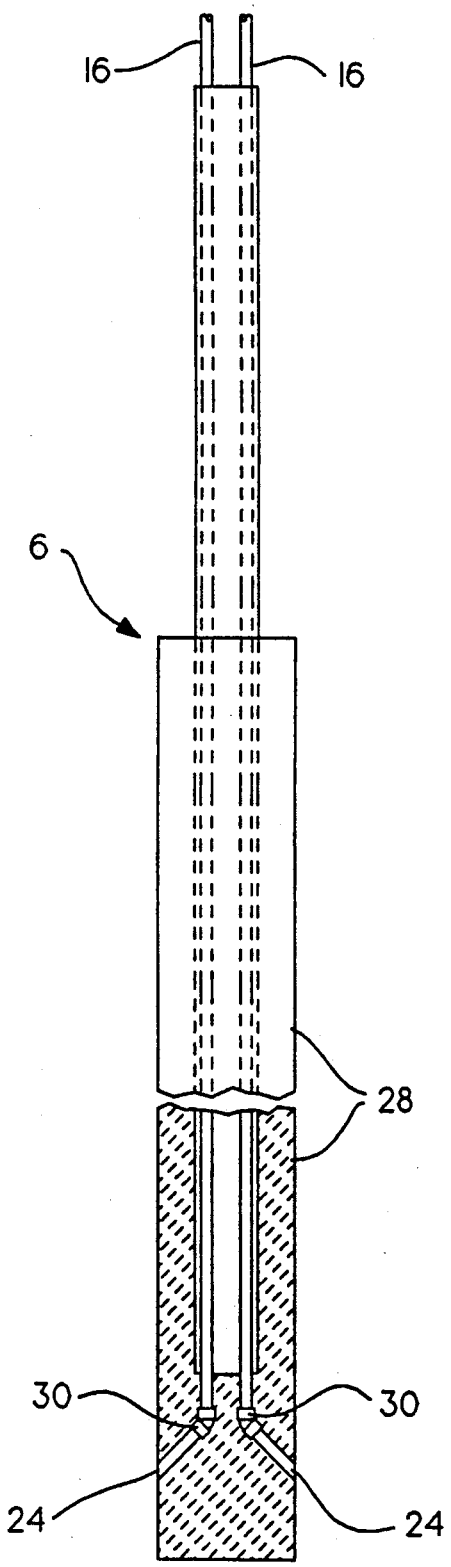
FIG. 4 is a cross-sectional view of a present preferred embodiment of the dual port lance of the present invention.
Figure 5:
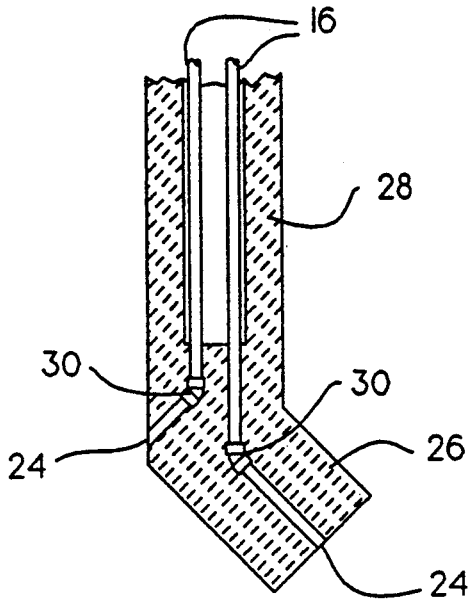
FIG. 5 is a cross-sectional view of a second embodiment of the dual port lance of the present invention.
Figure 6:
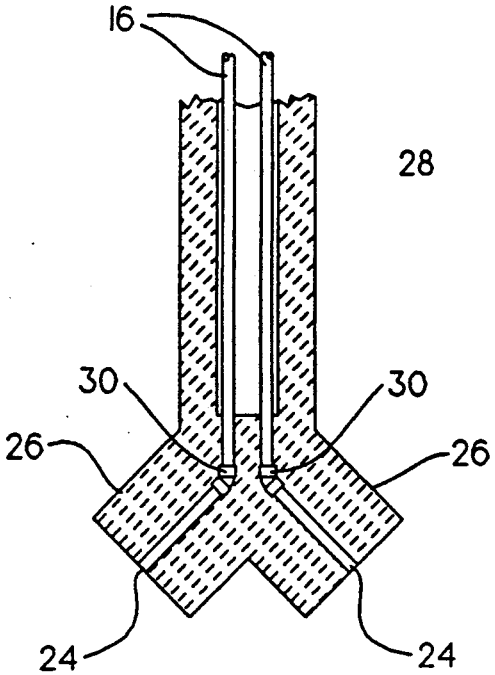
FIG. 6 is a cross-sectional view of a third embodiment of the dual port lance of the present invention.

Referring to FIGS. 4 through 6, three present preferred embodiments of the dual port lance of the present invention are illustrated. The injected mixture can be directed by choosing one of the illustrated embodiments. All three embodiments utilize conduits 16 which pass through a ceramic body 28 of the lance 6. Each of the three present embodiments of the invention provide that the injected reagent be evenly dispersed by having each of the exit ports 24 of the conduits positioned diametrically opposed to the other exit port 24. By having the exit ports 24 positioned in this way the treated metals are more homogeneous and of a higher quality. FIG. 4 illustrates the first preferred embodiment having an elongated lance 6 with two conduits 16 which at the exit ports 24 utilize an elbow fitting 30 such that the exit ports 24 extend at a 45° angle with respect to the longitudinal axis of the lance 6. The exit ports 24 can be extended further from the lance body 6 as shown in FIGS. 5 and 6 where either one or two bends 26 extend at 45° angles with respect to the longitudinal axis. In FIG. 5, one bend 26 is shown extending from the lance body 6 directing the flow of reagent to opposite sides and at different levels. In FIG. 6 two bends 26 extend from the lance body 6 at opposing 45° angles thus directing the flow of the reagent in opposing directions. The bends 26 extend beyond the lance body 6 and thus enable flow to be directed into the molten metal bath 2 more precisely than if no bend was utilized as in FIG. 4.

EXPERIMENTAL RESULTS

A series of comparative heats were made between the conventional single port lance and the present invention dual port lance which resulted in the conventional single port lance performing 28 heats prior to lance failure with each heat having an average immersion time of nine minutes. Thus the conventional single port lance had a cumulative immersion life of 250 minutes. In comparison, the present invention dual port lance performed 87 heats with an average injection rate of twice that of the conventional single port lance. The average immersion time of the present invention dual port lance was only four and one-half minutes. The total immersion time was 350 minutes for the 87 heats, after which the dual port lance had still not failed. It was observed that the amount of splash and turbulence was slightly more than that observed when the conventional single port lance was used.

In conclusion, the present invention dual port lance provides for less time necessary for injection per heat than was needed with the conventional lance which results in the present dual port lance performing more heats in the time normally necessary when using the conventional lance and performing more heats in the life of the lance than is normal. The benefit of using the present dual port lance compared to the conventional single port lance is a reduction of 50% in the injection time necessary which translates into a 100% increase in productivity.

Other benefits incurred by using the present invention dual port lance are reduction in injection time resulting in a reduction in temperature loss during the desulfurization process which further results in improved steelmaking operations and the capability of using more scrap in the oxygen converters. Furthermore, by decreasing the time of injection which is highly abrasive to the refractories there is a reduction in wear of the torpedo car which results in an increase in the service life of the torpedo car linings.

While we have shown and described certain present preferred embodiments of the invention it is to be distinctly understood that the invention is not limited thereto, but may be otherwise variously embodied within the scope of the following claims.

We claim:

1. An improved apparatus for treatment of molten metal contained in a vessel by injection of powdered reagent below the surface of said molten metal, including an elongated lance body having an upper and lower end and containing at least a pair of longitudinal conduits having an entry and exit port for delivery of said powdered reagent below the surface of said molten metal, the improvement comprising:

a first reagent supply means for delivering the reagent in a pressure stream into the entry port of one of said at least a pair of longitudinal conduits and out of the exit port of the one of said at least a pair of longitudinal conduits;

a second reagent supply means for delivering the reagent in a pressure stream into the entry port of another of said at least a pair of longitudinal conduits and out of the exit port of said another of said at least a pair of longitudinal conduits; and control means for independently regulating the separate flow rates of said reagent through each of said at least a pair of longitudinal conduits.

2. The apparatus of claim 1 wherein said control means includes a single injector conduit which supplies the powdered reagent in a pressure stream to a series of feed control modules the number of which is equal to the number of said at least a pair of longitudinal conduits.

3. The apparatus of claim 1 wherein said control means includes a series of individual injectors conduits each having a feed control unit.

4. The apparatus of claim 1 including secondary longitudinal conduits contained in said lance body, the secondary longitudinal conduits each having entry and exit ports positioned at the upper and lower end of the elongated lance body, respectively, such that the entry and exit ports of the at least a pair of longitudinal conduits are located at the same longitudinal position along the elongated lance body as the entry and exit ports of the secondary longitudinal conduits and wherein gases are injected through said secondary longitudinal conduits into the molten metal wherein the gases act as a stirring agent.

5. The apparatus of claim 1 wherein the lance body includes a ceramic body surrounding a support structure in which the at least a pair of conduits are positioned.

6. The apparatus of claim 1 wherein the lower end of said lance body includes a bend which extends at a 45° angle with respect to the longitudinal axis of said lance body such that one of the exit ports extends into said bend and wherein said at least a pair of conduits have an elbow fitting that allows said at least a pair of conduits exit ports to be positioned diametrically opposed to one another.

7. The apparatus of claim 1 wherein the lower end of said lance body includes two bends which extend at opposing 45° angles with respect to the longitudinal axis of the lance body and wherein said at least a pair of conduits have an elbow fitting that allows said at least a pair of conduits exit ports to extend at diametrically opposed 45° angles with respect to the longitudinal axis of the lance body.

8. The apparatus of claim 1 wherein the lower end of said lance body includes an elbow fitting connected to said at least a pair of conduits such that the exit ports of said at least a pair of conduits are positioned diametrically opposed with respect to one another.

9. The apparatus of claim 1 wherein the exit ports of the at least a pair of longitudinal conduits are positioned at the lower end of the elongated lance body.

10. A method of treatment of molten metal contained in a vessel wherein a lance body is immersed within the vessel and includes a pair of longitudinal conduits which deliver a powdered reagent from first and second reagent supply means to the molten metal comprising:

injecting said powdered reagent in a gaseous stream through said pair of longitudinal conduits; and connecting control means to said pair of longitudinal conduits wherein the control means are for independently controlling the separate flow rates of the powdered reagent passing through said pair of longitudinal conduits.

11. The method of claim 10 including the step of adjusting the flow rate of the injected reagent in order to prevent unacceptable splash and turbulence.

12. The method of claim 10 wherein an obstruction clogging one of said pair of longitudinal conduits is removed by the steps including:

monitoring of the obstruction;

increasing of pressure which tends to clear the obstruction; and decreasing of pressure to a normal level once the obstruction is cleared.

* * * * *

UNITED STATES PATENT AND TRADEMARK OFFICE

CERTIFICATE OF CORRECTION

PATENT NO. : 5,188,661

DATED : February 23, 1993

INVENTOR(S) : DONALD R. COOK, JOSEPH A. MACRI

It is certified that error appears in the above-identified patent and that said Letters Patent is hereby corrected as shown below:

Column 6, line 18, claim 3, change "injectors" to --injector--.

Signed and Sealed this

Eighteenth Day of January, 1994

*Attest:*

Bruce Lehman

BRUCE LEHMAN

*Attesting Officer*

*Commissioner of Patents and Trademarks*